US011352829B2

(12) United States Patent
McCoy et al.

(10) Patent No.: US 11,352,829 B2
(45) Date of Patent: Jun. 7, 2022

(54) WINDOW ASSEMBLY HAVING FRAMELESS APPEARANCE AND REMOVABLE GLASS PANEL

(71) Applicant: Fleetwood Aluminum Products, Inc., Corona, CA (US)

(72) Inventors: Mark S. McCoy, North Tustin, CA (US); Joseph A. Zammit, Riverside, CA (US); Kevin M. Nguyen, Eastvale, CA (US); Jordan James Robison, Lake Elsinore, CA (US); Gary P. Gumbleton, Riverside, CA (US); Nathan Douglas Baker, Menifee, CA (US)

(73) Assignee: Fleetwood Aluminum Products, Inc., Corona, CA (US)

( * ) Notice: Subject to any disclaimer, the term of this patent is extended or adjusted under 35 U.S.C. 154(b) by 16 days.

(21) Appl. No.: 17/001,545

(22) Filed: Aug. 24, 2020

(65) Prior Publication Data

US 2022/0056753 A1 Feb. 24, 2022

(51) Int. Cl.
*E06B 1/40* (2006.01)
*E06B 1/34* (2006.01)

(52) U.S. Cl.
CPC ..... *E06B 1/40* (2013.01); *E06B 1/342* (2013.01)

(58) Field of Classification Search
CPC ... E06B 1/04; E06B 1/36; E06B 1/363; E06B 1/366; E06B 1/38; E06B 1/702; E06B 3/5892; E06B 3/6621
USPC ..... 52/204.1, 213, 215, 216
See application file for complete search history.

(56) References Cited

U.S. PATENT DOCUMENTS 5,189,862 A * 3/1993 Lafleur ..... E06B 3/2605 52/204.593
5,893,600 A * 4/1999 McManus ..... E06B 3/38 296/146.16
8,484,902 B1 * 7/2013 Brown ..... E06B 3/26341 49/504
8,915,032 B1 * 12/2014 Rivera ..... E06B 1/363 52/204.595
2006/0248820 A1 * 11/2006 Silverman ..... E06B 3/5871 52/204.1
2008/0190030 A1 * 8/2008 Cheon ..... E06B 3/4609 49/425
2011/0010997 A1 * 1/2011 Kislov ..... E06B 9/02 49/141
2015/0121764 A1 * 5/2015 Lee ..... E05D 15/0682 49/420

* cited by examiner

*Primary Examiner* — William V Gilbert
(74) *Attorney, Agent, or Firm* — Vista IP Law Group LLP

(57) ABSTRACT

A window assembly for installing in a window framing (also referred to as a "window casing") of a wall of a building. The window assembly is configured to have a frameless appearance when installed with the finish surround installed around the interior and/or exterior of the window. The window assembly also allows the glass panel to be removed with a minimum of removal of the finish surround, such as without removing any of the finish surround, or only removing the finish surround around several sides of the only one of the interior or exterior of the window. For example, in most cases, only the interior finish surround around the right side and left side of the installed window frame needs to be removed to remove and replace the glass panel. Furthermore, the window assembly includes an integrated drain for draining moisture which leaks into the window assembly.

24 Claims, 9 Drawing Sheets

WINDOW ASSEMBLY HAVING FRAMELESS APPEARANCE AND REMOVABLE GLASS PANEL

BACKGROUND

The field of the invention generally relates to windows on buildings, and more particularly, to a window assembly that provides a flush to finish, frameless appearance and allows the window panes to be removed with minimal removal of finish surround around the installed window.

Windows on buildings, such as residential homes, apartments buildings, and business offices, typically comprise a window frame installed in an opening in a wall of the building, and a pane of glass installed in the window frame. A number of window designs have been previously disclosed. In some prior designs, a frame is installed into a rough window opening frame of a wall of a building, and then the glass panes are installed in the frame and glass stops are installed to hold the glass in the frame. FIG. 1 illustrates one such prior window design. The window 200 has a frame 212 which is installed in the window framing 214 forming the window opening in a wall. The glass panel 216 is installed in the frame 212, and then the glass stops 218 are inserted into the frame 212 to hold the glass panel 216 in place in the frame 212. Then, the finish surround 220 (i.e., the finished walls, interior finish surround 220*a* and exterior finish surround 220*b*) is constructed around the installed frame 212. The glass stops 218 remain exposed above the finish surround 220 so this design does not provide a frameless appearance.

FIG. 2 shows another prior design for a window 230 which, in this case, provides a frameless appearance. The window 230 includes a frame 232 and glass panel 234 installed in the frame 232. The glass pane 234 are installed within the window frame 232 with spacers 236 all around the glass panel 234, such that the glass panel 234 cannot be removed from the window frame 232 without disassembling the entire window frame 232. To install the window 230, the entire window 230 is positioned in a window framing 214 and then the window frame 232 is secured to the window framing 214 using fasteners, such as screws or nails. The finish surround 238 is then constructed around the installed window 230. As shown in FIG. 2, the window 230 has a frameless appearance (i.e., the window frame 232 does not extend beyond the edges of the finish surround 238 such that the window frame 232 is entirely inset into the finish surround 238. However, the glass panel 234 cannot be removed except by removing the entire finish surround 238, and disassembling the window frame 232. Indeed, the window 230 is not designed to allow the glass panes 234 to be removed and replaced.

Furthermore, in both of the prior window designs in FIGS. 1 and 2, the interior and exterior of the window framing cannot be finished until after the window 200 or 230 has been installed.

SUMMARY

The present invention is directed to an innovative window assembly including a window frame which receives a glass panel to form a window. The window assembly is configured for installing in a window framing (also referred to as a "window casing") of a wall of a building. The window may be a floor to ceiling window, side wall to side wall window or a smaller window that does not extend all the way to one or more of the floor, ceiling, and/or side walls. The window assembly is configured to have a frameless appearance when installed with the finish surround installed around the interior and/or exterior of the window. The term "frameless appearance" means the window frame of a window is at or below the surface of the finish surround walls around the entire window frame on the interior and exterior of the window frame. In other words, the window frame is inset such that it is at or below the surface of the finish surround. The innovative design of the window frame to be installed without the glass panel installed, and installing the finish surround around some or all of the window frame, and then installing the glass panel into the window frame. This avoids damaging the glass while installing the finish surround around the installed window frame. Moreover, the design of the window assembly also allows the glass panel to be removed with a minimum removal of the finish surround, such as without removing any of the finish surround, or only removing the finish surround around several sides of the only one of the interior or exterior of the window. For example, in most cases, only the interior finish surround around the right side and left side of the installed window frame needs to be removed to remove and replace the glass panel. Furthermore, the window assembly includes an integrated drain for draining moisture which leaks into the window assembly.

Accordingly, in one embodiment, a window assembly configured for installing in a window framing of a wall of a building comprises a window frame. The window frame is configured to mount in a window framing. The window frame includes a plurality of frame members including a head member, a sill member, a right side member, and a left side member. The frame members form a perimeter of the window frame. Each frame member has a respective full length from a first end of the frame member to a second end of the frame member.

Each of the frame members has an interior portion and an exterior portion. Each frame member extends substantially the full length of the respective frame member. The interior portion is configured to be positioned at an interior side of a glass panel when installed in the window frame. The exterior portion is configured to be positioned at an exterior side of the glass panel. Each of the interior portions is connected to a respective exterior portion. For example, the interior portion can be connected to the exterior portion using connectors, fasteners, adhesive, welding, etc., or they may even be integrally formed as a single part.

Each of the interior portions of the head member and sill member have a respective gasket for contacting and retaining the glass panel. The gasket may be an elastomer, polymer gasket which securely holds the glass panel, and also provides a seal between the interior portions and the surface of the glass panel.

Each of the exterior portions of the head member, sill member, right side member and left side member have a respective exterior retainer attachment. The exterior retainer attachments are configured to receive and retain a respective removable exterior retainer for holding the glass panel in the window frame. For example, the exterior retainer may be a male connector (e.g., a protrusion) which receives a mating female connector (e.g., a clip) of the exterior retainer, or vice versa.

The window assembly further includes respective exterior retainers that are removably attachable to the respective exterior retainer attachments. Each of the exterior retainers has a corresponding gasket for contacting and retaining the glass panel. When the exterior retainers are installed on the corresponding exterior retainer attachments, the exterior retainers hold the exterior side of the glass panel in the window frame.

Similarly, each of the interior portions of the right side member and left side member have a respective interior retainer attachment. The interior retainer attachments are same or similar to the exterior retainer attachments. A pair of interior retainers are removably attachable to the respective interior retainer attachments. Each interior retainer has a corresponding gasket for contacting and retaining the glass panel. When the interior retainers are installed on the corresponding interior retainer attachments, the interior retainers hold the interior side of the glass panel in the window frame.

The window frame assembly is configured such that when the window frame is installed in the window framing and finish surround is installed around the installed window frame assembly, the window frame assembly has a frameless appearance. In addition, the window frame is configured such that when the glass panel is installed into the window frame, there is an edge space between a top edge of the glass panel and the head member allowing the glass panel to be moved planarly upward to remove the glass panel from the window assembly without removing finish surround installed around the head member and sill member.

In another aspect of the window assembly, each exterior retainer and corresponding gasket extends substantially the full length of the respective frame member to which it is removably attachable. Similarly, each interior retainer and corresponding gasket extends substantially the length of the respective frame member to which it is removably attachable.

In still another aspect of the window assembly, each of the interior portions includes an interior wall having an inside edge and an outside edge and a first fastening wall extending laterally from the interior wall. The first fastening wall has one or more bosses for receiving fasteners for mounting the respective frame member to the window framing. Furthermore, each of the exterior portions includes an exterior wall having an inside edge and an outside edge and a second fastening wall extending laterally from the interior wall, the second fastening wall having one or more bosses for receiving fasteners for mounting the respective frame member to the window framing. Also, each respective interior portion is connected to a respective exterior portion by connecting the respective first fastening wall of the interior portion to the respective second fastening wall of the exterior portion. In another aspect, the first fastening walls may be attached to the respective second fastening wall with a respective thermal break connector which thermally insulates the interior portion from the exterior portion.

In another aspect of the window assembly, the respective interior portion of the head member and sill member further comprise a respective shelf portion. Each shelf portion includes a shelf wall extending interiorly from the interior wall of the first interior portion within the outside edge of the interior wall and a leg portion extending from an interior end of the shelf outward. Each shelf has one or more bosses for receiving a fastener for mounting the respective frame member to the window framing.

In another aspect, the window assembly also includes a fin member having a top end and a bottom end and extending a full height of the window frame. The fin member is configured to be attached to the glass panel to provide structural support, especially for multi-pane glass panels. For example, for a glass panel with a width of two glass panes attached edge to edge, the fin member may be positioned at the edge to edge connection of the two glass panes. The top end and bottom end of the fin member each have a plurality of bosses for receiving fasteners for mounting the fin member to the respective shelf portions of the interior portions of the head member and the sill member.

In still another aspect, the fin member may comprise a rectangular box beam and a pair of mounting feet extending from a first side of the rectangular box beam. The first side and mounting feet are configured to be attached to the glass panel, for example using structural adhesive and/or fasteners.

In still another aspect, the window assembly further includes a sill pan configured to receive the sill member and to collect water draining from the window assembly. One or more drains are coupled to a bottom of the sill pan and are in fluid communication with an interior of the sill pan for draining water from the sill pan.

In another aspect, the window assembly also includes a glass panel configured for being installed in the window frame with each of the retainers attached to the respective retainer attachment, such that each of the gaskets contacts and holds the glass panel in place in the window frame.

In yet another aspect, the glass panel comprises a plurality of end-long spaced glass panes attached together edge to edge. In such case, the window assembly may further comprise the fin member, described herein.

In still another aspect, the window assembly is configured such that the exterior retainers are selected from a selection of different exterior retainers, wherein each different exterior retainer configured to accommodate a different thickness of glass panel in the window frame. The exterior retainer attachments are configured to receive each of the different exterior retainers without any adjustment or alteration. Likewise, each of the different exterior retainers are configured to attach to the exterior retainer attachments without adjusting or altering the other components of the window assembly. In this way, the window assembly can accommodate glass panels of different thicknesses simply by using different exterior retainers, while all of the other components remain the same.

In another aspect, the window frame is configured to allow the glass panel to be removed without removing the window frame or the finish surround around the window frame. The window frame is configured such that when the glass panel is installed into the window frame, there is a respective edge space between respective edges of the glass panel and the right side member, and left side member allowing the glass panel to be moved planarly (i.e., in the plane of the glass panel) in the window frame. The interior retainers of the right side member and left side member are configured to be removed from the respective right side member and left side member after the window assembly is installed in the wall framing and finish surround is installed around an interior of the right side member and left side member without removing the finished surround along the right side member and left side member. A glass panel comprising a plurality of end-long spaced glass panes attached together edge to edge installed in a window frame with finish surround installed around the interior of the right side member and left side member is removable from the window frame interiorly without removing the finish surround installed around the interior of the right side member and left side member.

In another aspect, the window assembly is configured such that a glass panel installed in the window assembly installed in the window framing with finish surround installed around the entire installed window assembly is removable from the installed window assembly without removing any of the finish surround and without breaking the glass panel.

Another embodiment of the present invention is directed to a method of installing the window assembly disclosed herein into a window framing of a wall of a building. In one embodiment, the method includes installing each of the frame members of the window frame in a window framing of a building. A glass panel is positioned into the window frame. The exterior retainers and interior retainers are attached to their corresponding exterior retainer attachments and interior retainer attachments, respectively. The glass panel can be positioned into the installed window frame from the exterior or the interior side of the window.

In another aspect, the method further comprises installing finish surround around an entire interior and exterior of the installed window assembly. The finish surround is the finished walls and/or facade around the window, which gives a finished appearance to the walls around the window. For example, the finish surround may match the finished walls on the exterior or interior of the wall in which the window is installed. In one aspect of the method, the finish surround may be installed around the entire interior and exterior of the installed window assembly prior to positioning the glass panel into the window frame. In another aspect, the finish surround may be installed after positioning the glass panel into the window frame.

In another aspect, the glass panel may comprise a plurality of end-long spaced glass panes. For instance, large windows may utilized a glass panel having multiple glass panes which attach edge to edge to form a large window. Note that each glass pane may also have multiple overlaid panes of glass, such as dual-pane, triple-pane, glass panels. Each end-long glass pane is installed into the window frame separately, and then the glass panes are attached together edge to edge using a structural adhesive.

In another aspect of the method, a fin member is installed on the window. The fin member has a top end and a bottom end and extending a full height of the window frame. The fin member is installed by attaching the fin member to the glass panel at the attached edge of the glass panes, and the top end and bottom end of the fin member are attached to the respective interior portions of the head member and the sill member.

In yet another aspect, the glass panel is positioned into the window frame from the exterior, and while positioning the glass panel into the window frame, at least one of the interior retainers is attached to the corresponding interior retainer attachments and one or more of the exterior retainers are unattached to corresponding exterior retainer attachments. In still another aspect, the finish surround is installed around an entire interior of the installed window frame prior to positioning the glass panel into the window frame from the exterior side of the wall (i.e., the outside of the wall).

In still another aspect, the glass panel is positioned into the window frame from the interior, and at least one of the exterior retainers is attached to the corresponding exterior retainer attachments and one or more of the interior retainers are unattached to corresponding interior retainer attachments prior to positioning the glass panel into the window frame from the interior. In another aspect, the finish surround is installed around an entire exterior of the installed window frame prior to positioning the glass panel into the window frame from the interior side of the wall (i.e., the inside of the wall).

Another embodiment of the present invention is directed to removing a glass panel from the window assembly disclosed herein, wherein the window assembly and glass panel are installed in a window framing with finish surround installed around an entire interior and exterior of the installed window assembly. In one embodiment, the method includes removing the respective interior retainers from the respective interior retainer attachments of the right side member and left side member. Then, the glass panel is moved upward into the edge space in the head member. In this position, the glass panel is pivoted to move a bottom edge of the glass panel interiorly out from the sill member. The glass panel is then moved downward to remove the top edge of the glass panel out from the head member. This removes the entire glass panel from the window frame.

In another aspect of the method, the glass panel is removed without removing any of the finish surround from around the interior of the right side member and left side member.

In yet another aspect, prior to pivoting the glass panel, at least some of the finish surround is removed from around the interior of the right side member and left side member.

Another embodiment of the present invention is directed to removing a glass panel comprising multiple glass panes attached edge to edge using structural adhesive from a window assembly described herein, wherein the window assembly is installed in a window framing with finish surround installed around an entire interior and exterior of the installed window assembly. The glass panel comprises a plurality of glass panes, including at least a first glass pane and second glass pane forming the outer sides of the glass panel. The method includes detaching the first glass pane and second glass pane from the glass panel by removing the structural adhesive. The first glass pane is removed from the window assembly by first moving the first glass pane planarly out of the left side member (i.e., sliding it to the right). The first glass pane is moved upward into the edge space in the head member and then pivoted to move a bottom edge of the first glass pane interiorly out from the sill member. The first glass pane is moved downward to remove the top edge of the first glass pane out from the head member. The second glass pane is removed from the window assembly similarly, except that it is moved planarly out of the right side member (i.e., sliding it to the left).

In another aspect of the method of removing the multi-paned glass panel, the glass panel is removed without removing any of the finish surround from around the interior of the right side member and left side member.

In yet another aspect, one or more additional interior panes of plurality of glass panes may be removed by moving the interior glass pane upward into the edge space in the head member and pivoting the interior glass pane to move a bottom edge of the interior glass pane interiorly out from the sill member. Then, the interior glass pane is moved downward to remove the top edge of the interior glass pane out from the head member.

In additional aspects of the various methods of removing a glass panel from the window assembly, any one or more of the exterior retainers and/or interior retainers may be removed prior to removing the glass panel or glass panes of the glass panel. Removing one or more retainers may facilitate moving the glass panel/panes within the frame members, and also pivoting and removing the glass panel/panes.

As used herein, the term "flush" means that a respective surface of each of the referenced structures are even with each other such that no part protrudes out more than the other.

BRIEF DESCRIPTION OF THE DRAWINGS

The foregoing and other aspects of embodiments are described in further detail with reference to the accompanying drawings, wherein like reference numerals refer to like elements and the description for like elements shall be applicable for all described embodiments wherever relevant.

DETAILED DESCRIPTION

Figure 1:
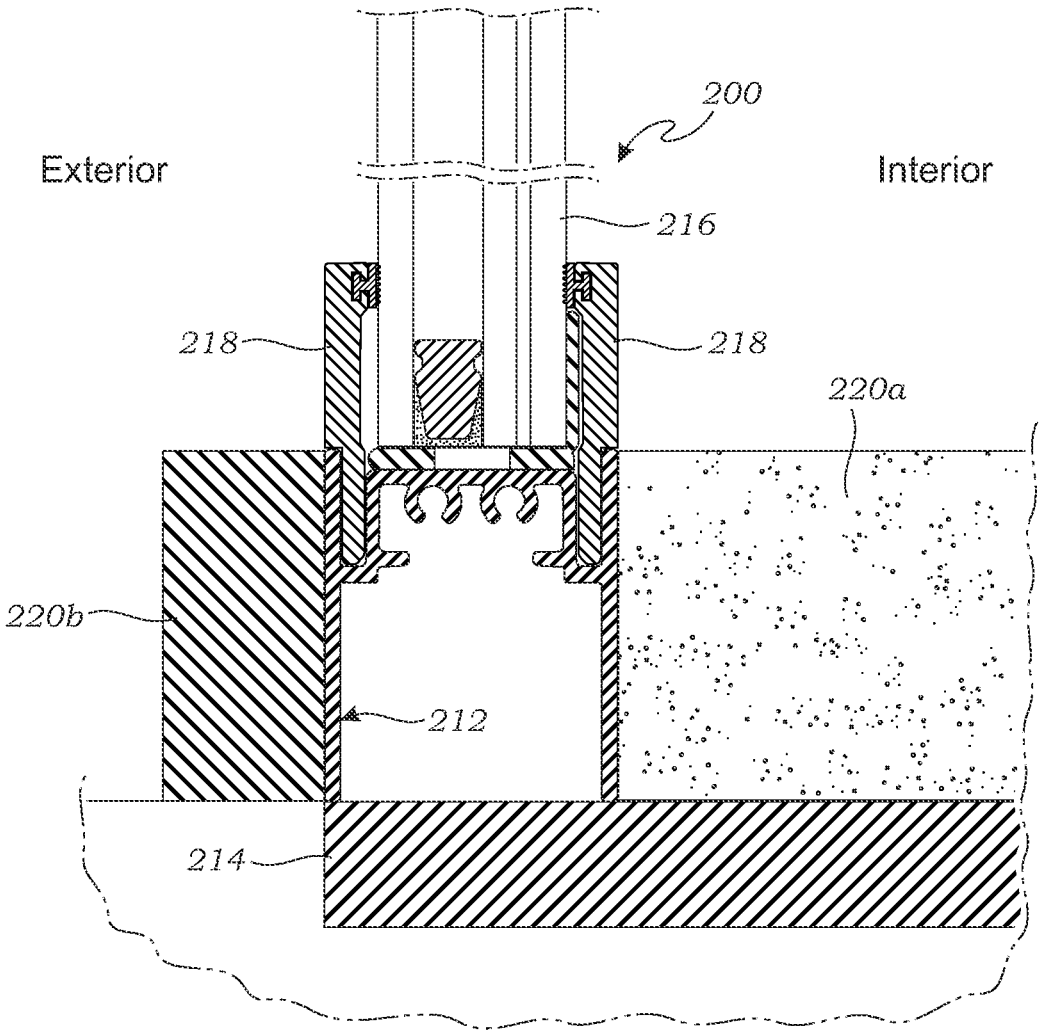
Fig. 1 (Prior Art)
FIG. 1 is a cross-sectional view of a window assembly in the prior art.
Figure 2:
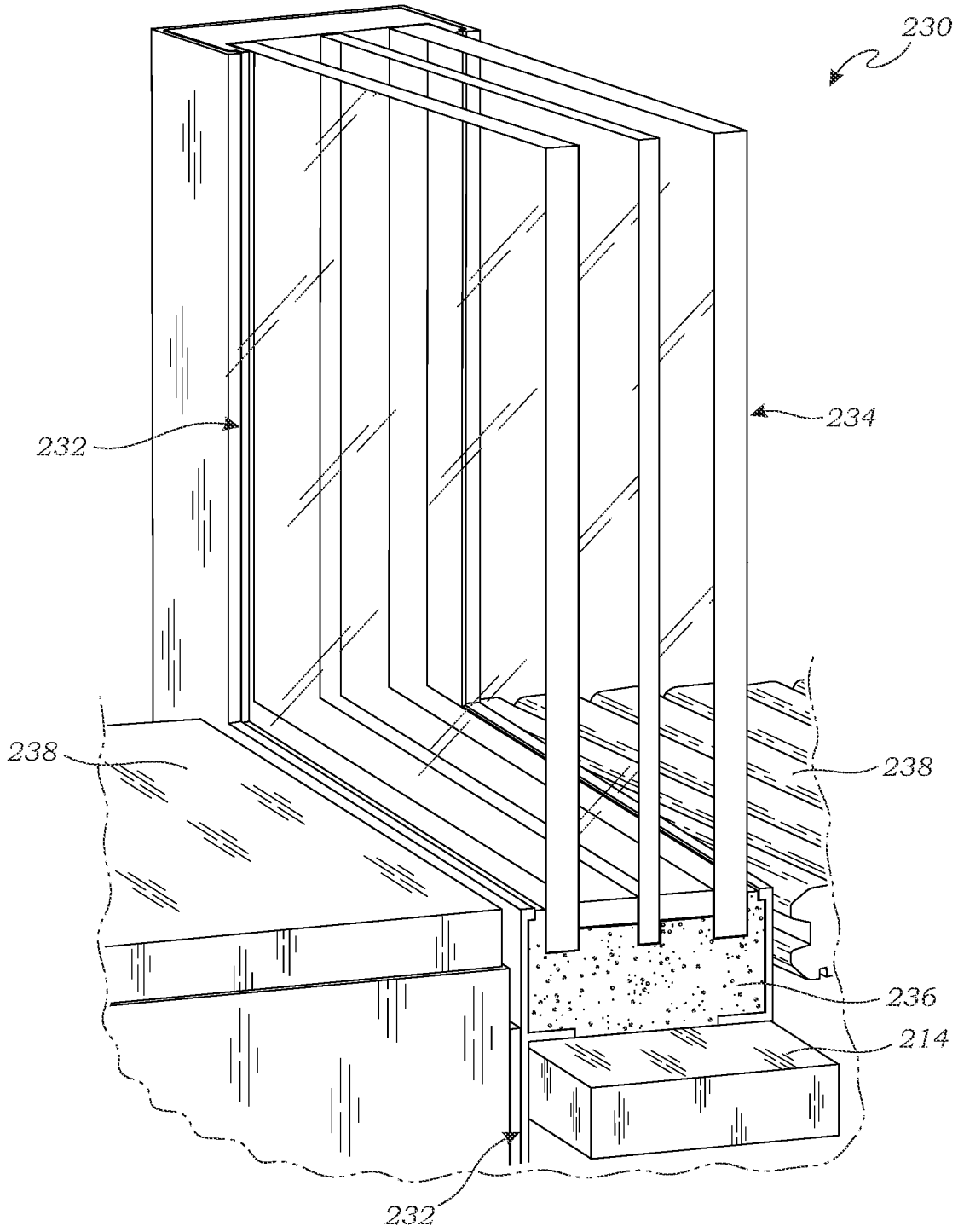
Fig. 2 (Prior Art)
FIG. 2 is a side, cut-away view of another window assembly in the prior art.
Figure 3:
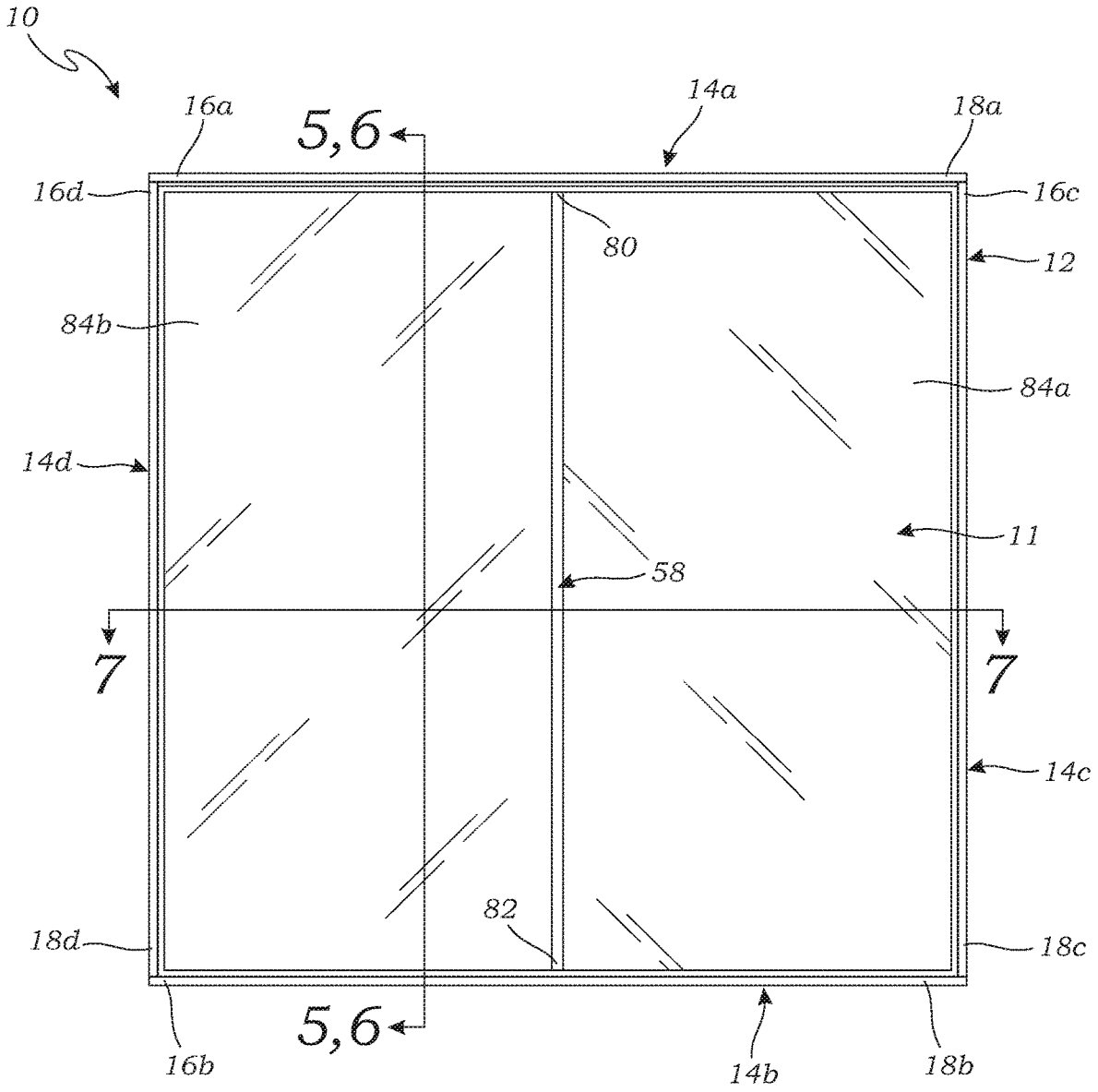
FIG. 3 is a side, schematic view of a window assembly, according to one embodiment of the present invention.
Figure 4:
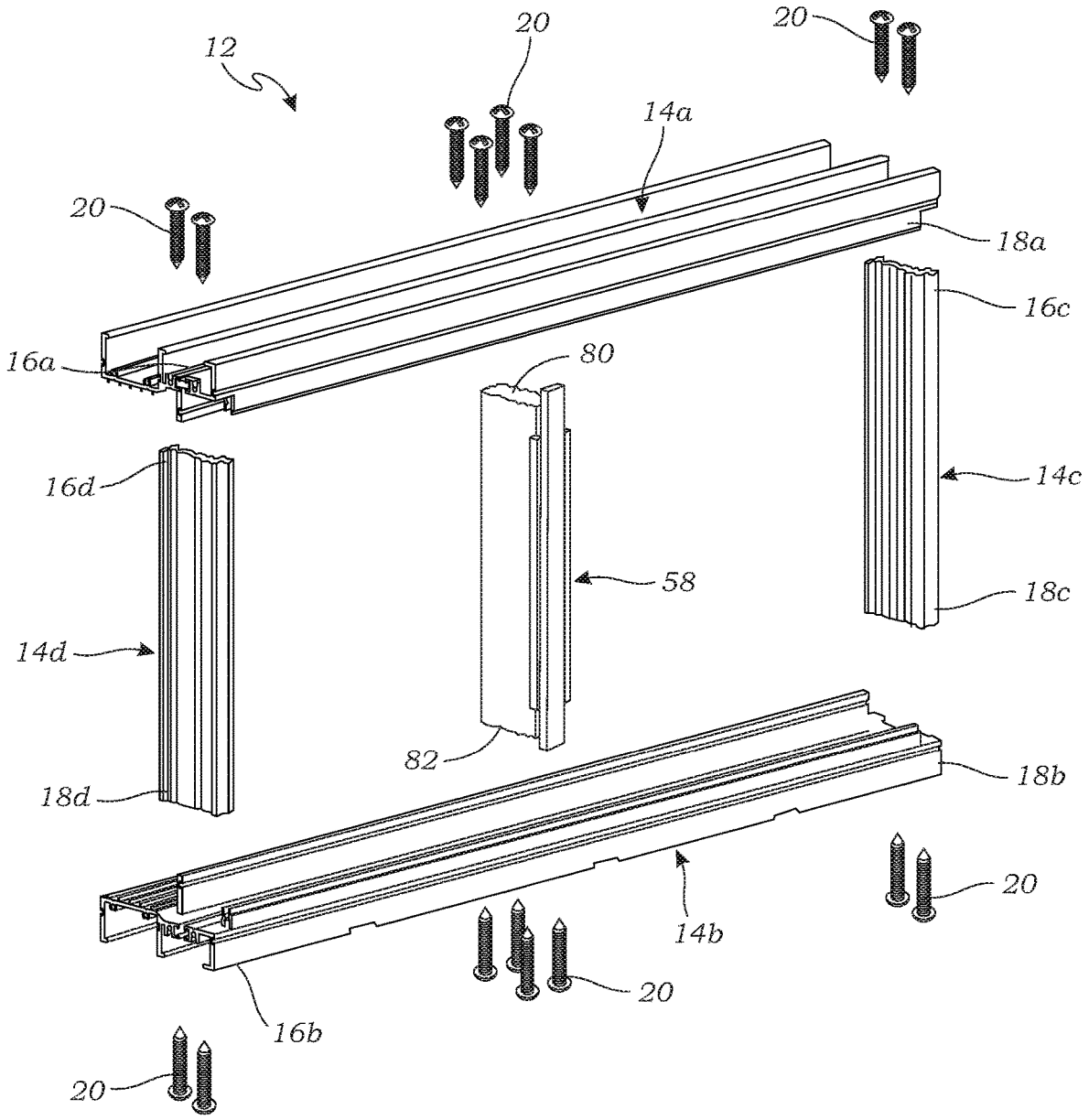
FIG. 4 is a front, perspective, exploded view of the window assembly of FIG. 3, according to one embodiment of the present invention.
Figure 5:
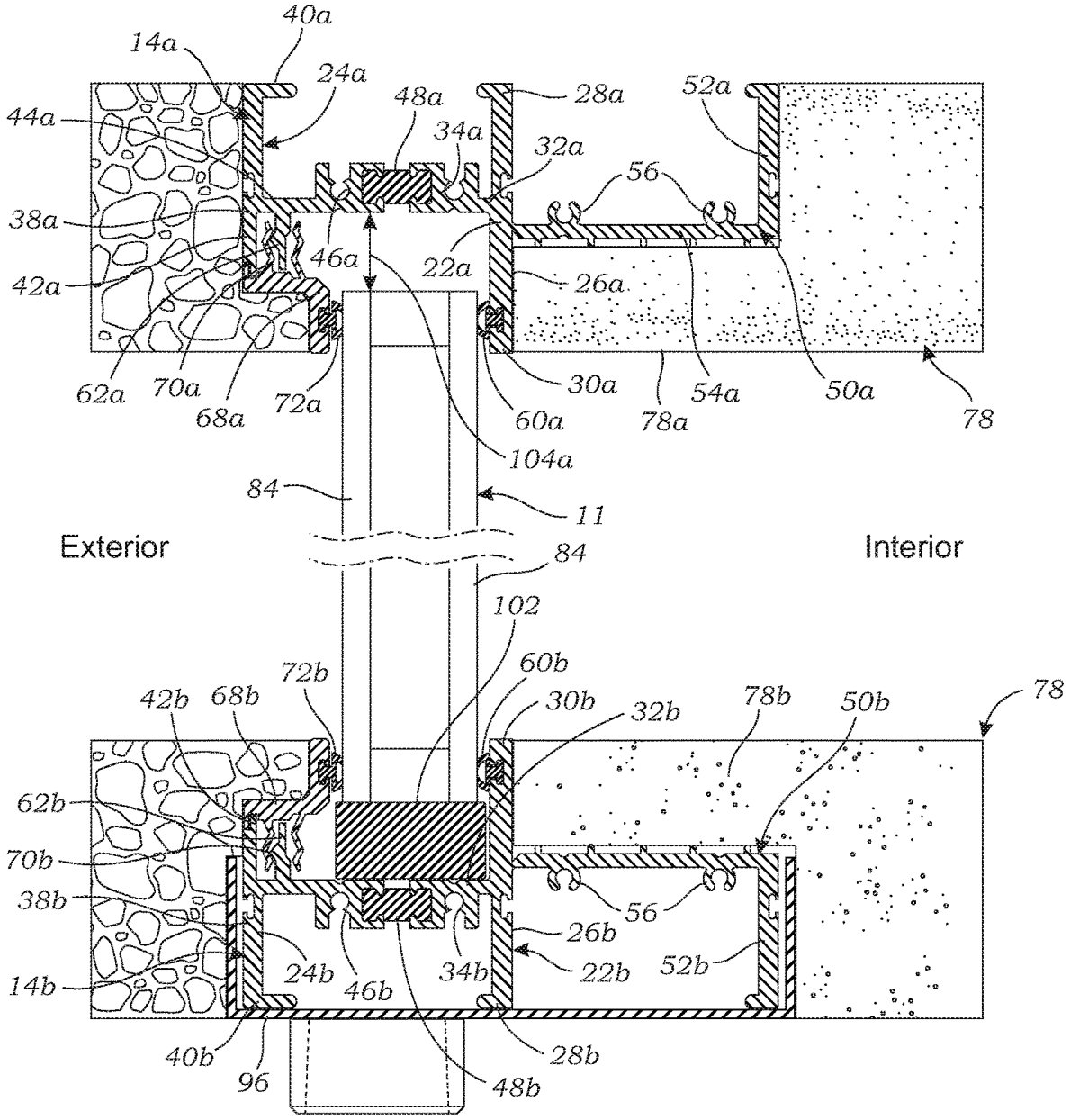
FIG. 5 is a cross-sectional view of the window assembly of FIG. 3 along line 5-5, according to one embodiment of the present invention.
Figure 6:
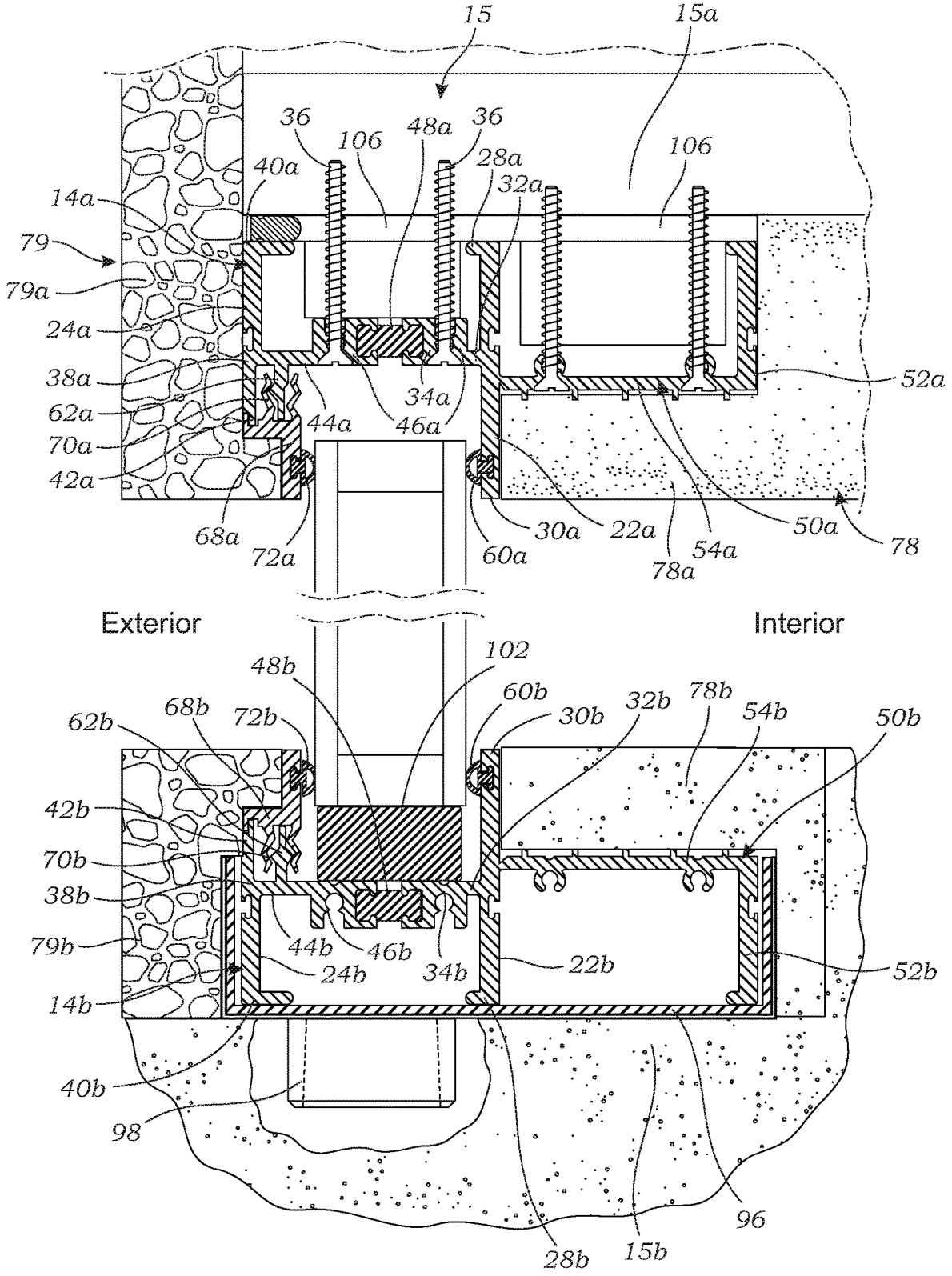
FIG. 6 is another cross-sectional view of the window assembly of FIG. 3 along line 5-5, showing the window frame mounting fasteners and window framing to which the window frame is attached, according to one embodiment of the present invention.
Figure 7:
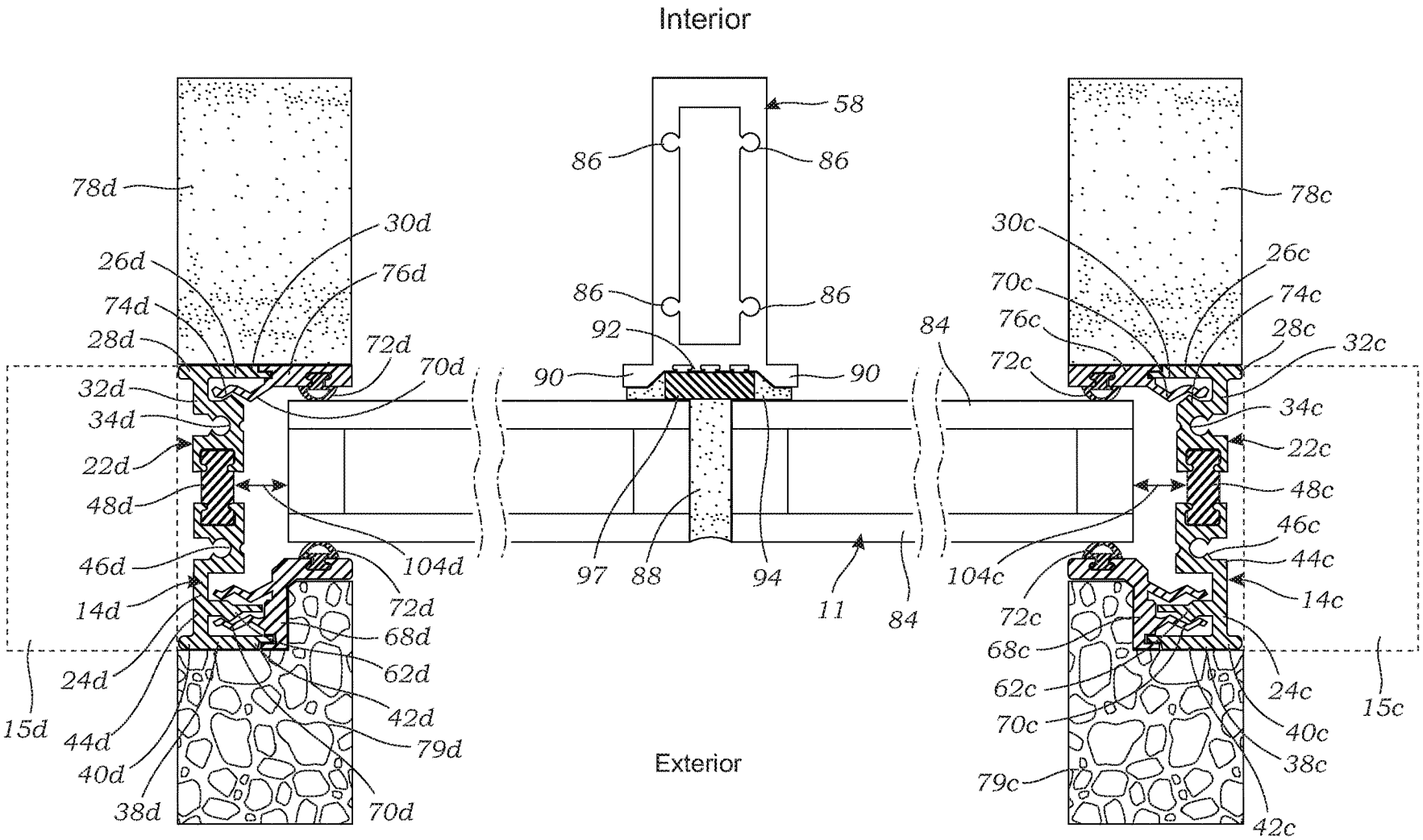
FIG. 7 is a cross-sectional view of the window assembly of FIG. 3 along line 7-7, according to one embodiment of the present invention.

Referring to FIGS. 3-9, one embodiment of a window assembly 10 according to the present invention is illustrated. The window assembly 10 is configured to be installed in a window framing 15 forming a window opening in a wall of a building, such as a residential home, apartment building, or business office. As shown in FIGS. 6 and 7, the window framing 15 includes a head 15*a*, a sill 15*b*, a right jamb 15*c* and a left jamb 15*d*. The window assembly 10 includes a window frame 12 having a plurality of frame members 14, including a head member 14*a*, a sill member 14*b*, a right side member 14*c*, and a left side member 14*d*. As shown in FIGS. 3 and 4, the frame members 14 form a closed perimeter of the window frame 12. Each frame member 14 has a first end 16 and a second end 18, and a respective full length extending from the first end 16 to the second end 18. Thus, the head member 14*a* has a first end 16*a* and a second end 18*a*, the sill member 14*b* has a first end 16*b* and a second end 18*b*, the right side member has a first end 16*c* and a second end 18*c*, and the left side member has a first end 16*d* and a second end 18*d*.

As shown in FIG. 4, the frame members 14 can be attached to each other using fasteners 20 to attach a first end 16 or second end 18 of one frame member 14 to first end 16 or second end 18 of the adjoining frame member 14.

Turning to FIGS. 5-7, each of the frame members 14 has an interior portion 22 and an exterior portion 24, such that the head member 14*a* has an interior portion 22*a* and an exterior portion 24*a*, the sill member 14*b* has an interior portion 22*b* and an exterior portion 24*b*, the right side member 14*c* has an interior portion 22*c* and an exterior portion 24*c*, and the left side member 14*d* has an interior portion 22*d* and an exterior portion 24*d*. The terms "interior" and "interiorly" refer to elements or relative positioning of elements which are towards the interior of the window (i.e., the inside of the window) relative to another element, while the terms "exterior" and "exteriorly" refer to elements or relative positioning of elements which are towards the exterior of the window (i.e., the outside of the window) relative to another element. The interior portions 22 are configured to be positioned on the interior side of the glass panel 11 when the window assembly 10 is installed, and the exterior portions 24 are configured to be positioned on the exterior side of the glass panel 11.

Each of the interior portions 22 includes an interior wall 26 having an outer edge 28 and an inner edge 30, and a fastening wall 32 extending laterally inward from the interior wall 26. The fastening wall 32 has one or more apertures 34 and/or bosses 34 for receiving fasteners 36 for mounting the respective frame member 14 to the window framing. The terms "outer," "outward", "outwardly" and the like, are relative to the perimeter and middle of the window assembly in an elevational view of the window assembly, such that these terms refer r to elements or relative positioning of elements which are towards the perimeter of the window relative to another element. The terms "inner," "inward", and "inwardly", are relative to the perimeter and middle of the window assembly in an elevational view of the window assembly, such that these terms refer to elements or relative positioning of elements which are toward the middle of the window relative to another element. For example, the outer edge 28 of each fastening wall 28 is toward the perimeter of the window assembly 10 relative to the inner edge 30.

Each of the interior portions 22*a*, 22*b* of the head member 14*a* and sill member 14*b* have a respective gasket 60*a*, 60*b* attached to exterior side of the respective interior walls 26*a*, 26*b* for contacting and retaining the glass panel 11 in head member 14*a* and sill member 14*b*. The gaskets 60*a*, 60*b* are an elastomer, polymer gasket which securely holds the glass panel 11, and seals between the interior walls 26*a*, 26*b* and the interior surface of the glass panel 11.

Each of the exterior portions 24 includes an exterior wall 38 having an outer edge 40 and an inner edge 42, and a fastening wall 44 extending laterally inward from the interior wall 26. The fastening wall 44 has one or more apertures 46 and/or bosses 46 for receiving fasteners 36 for mounting the respective frame member 14 to the window framing. The terms "outer," "outward", "outwardly" and the like, are relative to the perimeter and middle of the window assembly in an elevational view of the window assembly, such that these terms refer r to elements or relative positioning of elements which are towards the perimeter of the window relative to another element.

Each respective interior portion 22 is connected to the respective exterior portion 24 by connecting the respective fastening wall 32 of the interior portion 22 to a respective fastening wall 44 of the exterior portion 24. Each respective fastening wall 32 of the interior portion 22 is connected to the respective fastening wall 44 of the exterior portion 24 using a respective thermal break connector 48. The thermal break connectors 48 thermally insulate the corresponding interior portion 22 from the corresponding exterior portion 24. For instance, for the head member 14*a*, the interior portion 22*a* is connected to the exterior portion 24*a* by fastening the fastening wall 32*a* to the fastening wall 44*a* using the thermal break connector 48*a*.

The description is the same for each of the other frame members 14. The thermal break connectors 44 may be formed of a polymer material such as polyurethane (0.02 W/(m K)) or other suitable plastic material (about 0.02-0.50 W/(m K), which has a much lower thermal conductivity than metals like aluminum and steel. Alternatively, the interior portions 22 may be connected to respective exterior portions 24 using connectors, fasteners, adhesive, welding, etc., or they may be formed as an integral part.

The respective interior portion 22 of each of the head member 14*a* and sill member 14*b* have a respective shelf portion 50*a*, 50*b*. The shelf portion 50 is disposed on the interior side for the interior wall 26. Each shelf portion 50 includes a shelf wall 52 connecting to, and extending interiorly from, the interior wall of the interior portion and a support wall 54 extending outward from an interior end of the shelf wall 52. The shelf wall 52 has one more bosses 56 for receiving a fastener for mounting the respective frame member 14*a*, 14*b* to the window framing. The shelf wall 52 also has one or more bosses or apertures for receiving fasteners for attaching the fin member 58 to the shelf portions 50*a*, 50*b*.

Each of the exterior portions 24 of the frame members 14 have a respective exterior retainer attachment 62. The exterior retainer attachments 62 are configured to receive and retain a respective removable exterior retainer 68 for holding the glass panel 11 in the window frame 12. In the illustrated embodiment, the exterior retainer attachments 62 comprise a male connector 62 (e.g., a protrusion) extending inwardly from the respective fastening wall 44. The male connectors 62 include a diamond shaped bulb which receives a mating female connector 70 (e.g., a clip 70) of the exterior retainer 68, or vice versa.

The window assembly 10 also has respective exterior retainers 68 that are removably attachable to the respective exterior retainer attachments 62. The exterior retainers 68 comprise a clip 70 which removably attaches to the male connector 62 of the exterior retainer attachment 62. Each of the exterior retainers 68 has a corresponding gasket 72 for contacting and retaining the glass panel 11. When the exterior retainers 68 are installed on the corresponding exterior retainer attachments 62, the exterior retainers 68 hold the exterior side of the glass panel 11 in the window frame 12. The gaskets 72*a*, 72*b* are an elastomer, polymer gasket which securely holds the glass panel 11, and provides a seal between the head member 14*a* and sill member 14*b* and the exterior surface of the glass panel 11.

Figures 8A, 8B, 8C:
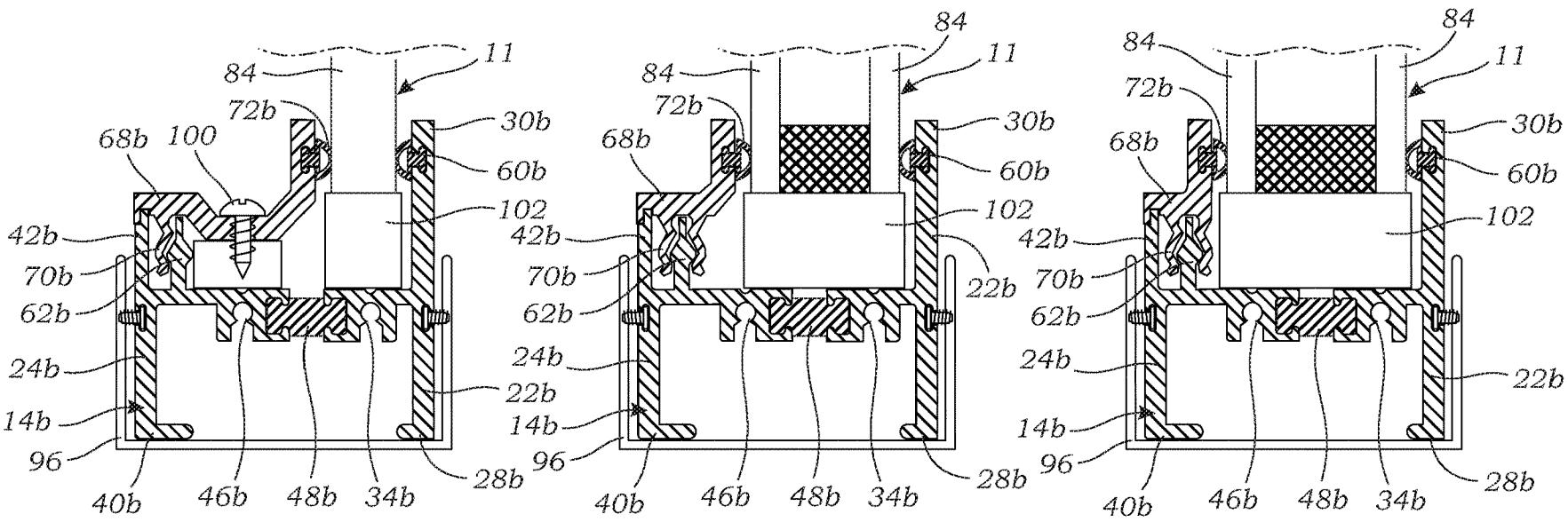
FIGS. 8A-8C show cross-sectional views of the sill frame member of the window assembly of FIG. 3 with three different exterior retainers for supporting different thicknesses of glass panels in the window frame, according to one embodiment of the present invention.

Turning to FIG. 8, the window frame 12 is configured such that it can accommodate different thicknesses of glass panels 11 in the window frame assembly 10. FIGS. 8A-8C illustrate the sill member 14*b* having different exterior retainers 68*b* for accommodating different thicknesses of glass panels 11. The exterior retainers 68*a*, 68*c* and 68*d* would be modified in the same way as the exterior retainer 68*b* to accommodate the different thicknesses of glass panels 11 shown in FIGS. 8A-8C. For instance, FIG. 8A shows a portion of a window assembly 10 having a relatively thin glass panel 11A. The glass panel 11A comprises a single glass pane 84 in thickness (e.g., the thickness of the single glass pane 84 may be about 9/16 inch). To accommodate the thin glass panel 11A, the exterior retainer 68*b* (as well as the other exterior retainers 68*a*, 68*c*, and 68*d*) is wider in dimension from its connection with the exterior wall 24*b* to the gasket 72*b* where the exterior retainer 84 contacts the exterior surface of the glass panel 11A. Support screws 100 are also used to attach the exterior retainers 68 to reinforce the connection of the exterior retainers 68 to the exterior retainer attachments 62.

FIG. 8B shows a portion of a window assembly 10 having a thicker glass panel 11B than the thin glass panel 11A of FIG. 8A. The glass panel 11B is dual glass pane 84 in thickness, with a space between each pane 84 (e.g., the thickness of the dual glass pane 84 may be about 1-3/8 inches). To accommodate the thicker glass panel 11B, the exterior retainer 68*b* (as well as the other exterior retainers 68*a*, 68*c*, and 68*d*) is narrower in dimension than in FIG. 8A from its connection with the exterior wall 24*b* to the gasket 72*b* where the exterior retainer 84 contacts the exterior surface of the glass panel 11B.

FIG. 8C shows a portion of a window assembly 10 having an even thicker glass panel 11C than the glass panel 11B of FIG. 8B. The glass panel 11C is also a dual glass pane 84 in thickness, with a wider space between each pane 84 than the glass panel of 11B (e.g., the thickness of the dual glass pane 84 may be about 1.5 inches). To accommodate the thicker glass panel 11C, the exterior retainer 68*b* (as well as the other exterior retainers 68*a*, 68*c*, and 68*d*) is even narrower in dimension than in FIG. 8B from its connection with the exterior wall 24*b* to the gasket 72*b* where the exterior retainer 84 contacts the exterior surface of the glass panel 11C.

Thus, the window assembly 10 is configured such that the exterior retainers 68 are selected from a selection of different exterior retainers 68, wherein each different exterior retainer 68 is configured to accommodate a different thickness of glass panel 11 in the window frame 12. The exterior retainer attachments 62 are configured to receive each of the different exterior retainers 68 without any adjustment or alteration. Moreover, each of the different exterior retainers 68 are configured to attach to the exterior retainer attachments 62 without adjusting or altering the other components of the window assembly 10. In this way, the window assembly 10 can be configured to accommodate glass panels 11 of different thicknesses by selecting and using the appropriate exterior retainers 68, while all of the other components of the window assembly 10 remain the same.

Similarly, each of the interior portions 22*c*, 22*d* of the right side member 14*c* and left side member 14*d* have respective interior retainer attachment 74*c*, 74*d*. The interior retainer attachments 74 are configured to receive and retain a respective removable interior retainer 76 for holding the glass panel 11 in the window frame 12. The interior retainer attachments 74 have a male connector (e.g., a male bulb, as shown) extending inwardly from the respective fastening wall 32. The male connector is configured to receive a mating connector female connector 70 (e.g., a clip 70) of the interior retainer 76, or vice versa. Respective interior retainers 76 are removably attachable to the respective interior retainer attachments 74. The interior retainers 76 comprise a clip 70 which removably attaches to the male connector of the interior retainer attachment 74. Each of the interior retainers 76 has a corresponding gasket 72 for contacting and retaining the glass panel 11. When the interior retainers 76 are installed on the corresponding interior retainer attachments 74, the interior retainers 76 hold the interior side of the glass panel 11 in the window frame 12. The gaskets 72*c*, 72*d* are an elastomer, polymer gasket which securely holds the glass panel 11, and seals between the interior retainers 76 and interior walls 22 and the interior surface of the glass panel 11. As shown in FIG. 7, the interior retainers 76 and interior retainer attachments 74 are configured such that the interior retainers 76 can be removed and/or installed with the window frame assembly 10 fully installed and the interior finish surround 78*c*, 78*d*, fully installed around the interior of the right side member 14*c* and the left side member 14*d* without removing such finish surround.

Each of the exterior retainers 68, interior retainers 76, and corresponding gaskets 72 extends substantially the full length of the respective frame member 14 to which it is removably attachable.

The window assembly 10 may also include a fin member 58 having a top end 80 and a bottom end 82 and extending a full height of the window frame 12. The fin member 58 is optional, and may not be used in some cases, such as for smaller glass panels 11 having only a single glass pane 84. In some cases, the glass panel 11 may comprise a plurality of side-to-side spaced glass panes 84 (also referred to as "end-long glass panes"). For instance, large windows may utilize a glass panel 11 having multiple glass panes 84 which attach edge to edge to form a large window. In addition, each glass pane 84 may also have multiple overlaid panes of glass, such as dual-pane, triple-pane, glass panels. The end-long glass panes 84 are attached together edge to edge using a structural adhesive 88 (see FIG. 7).

The fin member 58 is configured to be attached to the glass panel 11 to provide structural support, especially for glass panels 11 having two or more end-long glass panes 84. The embodiment illustrated in FIGS. 3-9 has a glass panel 11 having two end-long glass panes 84 attached edge to edge, as illustrated in the FIG. 3. For a glass panel 11 comprising two or more end-long glass panes 84 attached together edge to edge, a respective fin member 58 may be positioned at each of the edge to edge connections of the glass panes 84. The top end 80 and bottom end 82 of the fin member 58 each have a plurality of bosses 86 for receiving fasteners for mounting the fin member 58 to the respective shelf portions 50 of the interior portions 22 of the head member 14*a* and the sill member 14*b*. The fin member 58 may be in the form of a rectangular box beam, or other suitable shape. The fin member 58 may also have a pair of mounting feet 90 extending from a first side 92 of the rectangular box beam. The first side 92 and mounting feet 90 are configured to be attached to the glass panel 11 along the interface of adjacent end-long glass panes 84 using structural adhesive 94 and/or fasteners. A fin spacer 97 may be disposed between the fin member 58 and the glass panes 84. The fin spacer 97 provides a consistent space for the structural adhesive 94 to attach the fin member 58 to the glass panes 84.

The window assembly 10 also has a sill pan 96 (or Arche-Duct 96) which receives and surrounds the sill member 14*b* (including the shelf portion 52*b*) to collect water draining from the window assembly 10. One or more drains 98 are coupled to a bottom of the sill pan and are in fluid communication with an interior of the sill pan 96 for draining water from the sill pan 96.

The window assembly 10 includes a setting block 102 which is placed on the sill member 14*b* upon which the glass panel 11 rests when installed in the window frame 12. As shown in FIGS. 5-7, the assembled window frame 12 maintains an edge space 104 between the outer edge of the glass panel 11 and the respective head member 14*a*, right side member 14*c* and left side member 14*d* which allows the glass panel 11 to be moved planarly (i.e., in a direction in the plane of the glass panel 11) upward into the head member 14*a*, right side member 14*c* and/or left side member 14*d*. This planar movement allows the glass panel 11 to be installed and/or removed from the installed window assembly 10 without removing the finish surround around one or more of the frame members 14, as described herein.

FIGS. 5 and 6 illustrate the window assembly 10 is installed in the window framing 15 with finish surround installed around the entire interior and exterior of the window assembly 10. The finish surround includes interior finish surround 78, which includes interior finish surround 78*a* around the interior of the head member 14*a*, interior finish surround 78*b* around the interior of the head member 14*b*, interior finish surround 78*c* around the interior of the right side member 14*c*, and interior finish surround 78*d* around the interior of the left side member 14*d*. The exterior finish surround 79 includes exterior finish surround 79*a* around the exterior of the head member 14*a*, exterior finish surround 79*b* around the exterior of head member 14*b*, exterior finish surround 79*c* around the exterior of the right side member 14*c*, and exterior finish surround 79*d* around the exterior of the left side member 14*d*. Accordingly, the window assembly 10 has a frameless appearance when installed with the finish surround 78, 79 installed around the interior and/or exterior of the window.

Various methods of installing the window assembly 10 into the window framing 15 will now be described. In one embodiment, the window assembly 10 is installed without any of the finish surround 78, 79 installed at the commencement of the installation. The method includes first installing the sill pan 96 into the sill 15*b* of the window framing 15. One or more shims or leveling filler may be used to level the sill pan 96. One or more drains 98 (e.g., drain pipes) are connected to the sill pan 96.

The frame members 14*a*, 14*b*, 14*c*, 14*d* are assembled with screws (see FIG. 4) to form the window frame 12. Preferably, the frame members 14 are assembled without the interior retainers 76*c*, 76*d*, and exterior retainers 68*a*, 68*b*, 68*c*, 68*d* installed on the frame members 14, but the window frame 12 can be assembled with the retainers 68, 76 installed, but then at least some need to be removed before installing the glass panel 11. If one or more fin members 58 are being utilized, the fin member(s) 58 are also installed in the window frame 12 using screws to attach the respective top end 80 to the shelf portion 50*a* of the head member 14*a* and the respective bottom end 82 to the shelf portion 50*b* of the sill member 14*b*. A compatible sealant may be applied to the corners of the frame at the interface of the adjoining frame members 14.

The assembled window frame 12 is installed in the window framing 15 with the sill member 14*b* received in the sill pan 96. Each of the respective frame members 14*a*, 14*b*, 14*c*, 14*d* are fastened to the corresponding head 15*a*, sill 15*b*, right jamb 15*c* and left jamb 15*d* using screws 36 inserted through the bosses or apertures 46 of each frame member 14 and driven into the corresponding part of the window framing 15. One or more shims 106 may be used between the frame members 14 and the respective head 15*a*, right jamb 15*c*, and left jamb 15*d* (see FIG. 6) to plumb, square, level and/or size adjust the window frame 12 to the window framing 15. All of the screw heads 36 and any other holes are sealed with a compatible sealant. A bead of compatible sealant is also applied to the entire exterior and interior joint between the window frame 12 and the window framing 15. The sealant is tooled to eliminate bubbles, void and/or breaks and to ensure a completely watertight seal.

The appropriate size exterior retainers 68 may be selected from a selection of different exterior retainers 68 configured for accommodating different thicknesses of glass panels 11. The exterior retainers 68 and interior retainers 76 may be field cut to size after the window frame 12 is assembled and/or installed in the window framing 15. Each exterior retainer 68 and interior retainer 76 is field cut to fit the corresponding frame member 14, and may be test fit to ensure proper fit. The exterior retainers 68 and interior retainers 76 are then removed prior to installing the glass panel 11.

Figure 9:
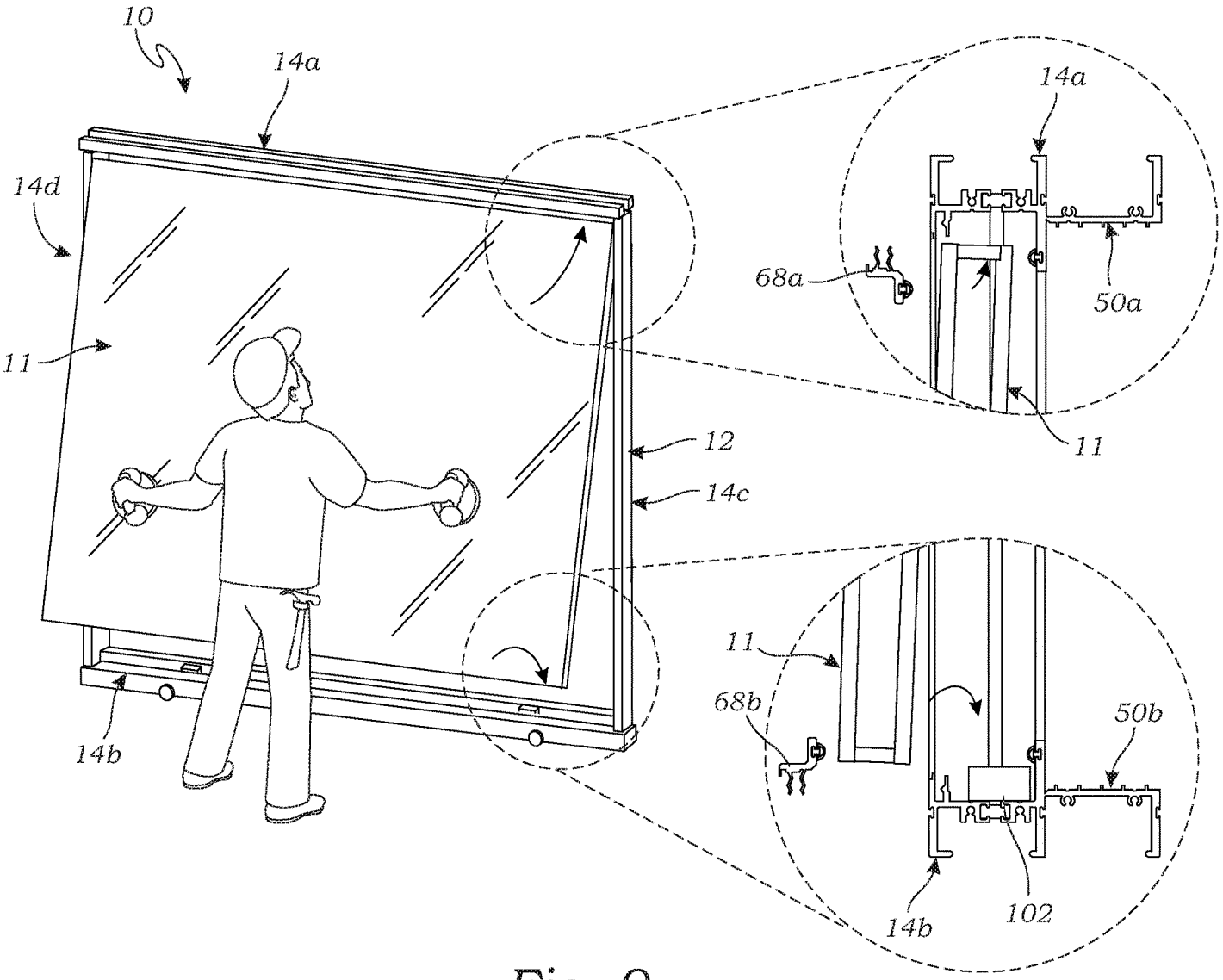
FIG. 9 is a schematic illustrating a method for installing and/or removing a glass panel from a window assembly, according to one embodiment of the present invention.

Turning to FIG. 9, the glass panel 11 is then installed into the window frame 12. First, setting blocks 102 are installed in the sill member 14*b* at each quarter length of the sill member 14*b* or as needed. With the glass panel 11 on the exterior of the window frame 12, the top edge of the glass panel 11 is then inserted into the head member 14*a* with the glass panel 11 angled such that the bottom edge of the glass panel is exterior to the sill member 14*b*. The glass panel 11 is pushed upward such that the top edge inserts in to the edge space 104*a* of the head member 14*a*, and the bottom edge is swung inward until vertical with the bottom edge over the setting blocks 102 in the sill member 14*b*. Then, the glass panel 11 is lowered such that the bottom edge inserts into the sill member 14*b* and rests on the setting blocks 102. Then, the glass panel 11 is centered horizontally. With the glass panel 11 in place in the window frame 12, the exterior retainers 68*a*, 68*b*, 68*c*, 68*d* and the interior retainers 76*c*, 76*d* are installed on their corresponding exterior retainer attachments 62*a*, 62*b*, 62*c*, 62*d* and interior retainer attachments 74*c*, 74*d*.

If a fin member 58 is utilized in the window assembly 10, then the method also includes the following. The fin spacer 97 may have two opposing sides having pre-applied adhesive. A first adhesive side attaches the fin spacer 97 to the fin member 58. The fin spacer 97 may be pre-attached to the fin member 58, or it may be attached to the fin member 58 during installation of the window assembly 10. The fin spacer 97 is attached to the fin member 58 prior to the glass panel 11 being positioned in the installed window frame 12. The second adhesive side has a protective film over the adhesive. After the glass panel 11 is positioned in the installed window frame 12, the protective film is removed such that the second adhesive side attaches to the interior surface of the glass panel 11. Structural sealant 94 is then applied between the glass panel 11 and the fin member 58.

Then, the finish surround, including the interior finish surround 78 and exterior finish surround 79 is installed around the entire interior and exterior of the installed window assembly 10, such that the finish surround 78, 79 is flush, or slightly above, the window frame 12. Again, this provides an installed window assembly 10 having a frameless appearance.

Alternatively, the method of installing the window assembly 10 may have the glass panel 11 positioned into the installed window frame 12 from the interior side of the window in substantially the same manner.

In another alternative of the method, one or more of the interior retainers 76*a*, 76*b*, 76*c*, 76*d* may be installed on the respective interior retainer attachments 74*a*, 74*b*, 74*c*, 74*d*, and one or more of the exterior retainers 68 are unattached to corresponding exterior retainer attachments 62, prior to positioning the glass panel 11 into the window frame 12, and while positioning the glass panel 11 into the window frame 12.

In another alternative of the method, the finish surround 78, 79 is installed around the entire interior and exterior of the window framing 15 prior to positioning the glass panel 11 into the window frame 12 from the exterior side of the window frame 12.

In another alternative of the method, the finish surround 78, 79 is installed around then entire interior and exterior of the window framing 15 prior installing the window frame 12 into the window framing 15.

In another alternative of the method, the glass panel 11 is positioned into the installed window frame 12 from the interior, and at least one of the exterior retainers 68 is attached to the corresponding exterior retainer attachments 62 and one or more of the interior retainers 76 are unattached to corresponding interior retainer attachments 72, prior to positioning the glass panel 11 into the window frame 12 from the interior. In another alternative, the entire exterior finish surround 79 is installed around the entire exterior of the installed window frame 12 prior to positioning the glass panel 11 into the window frame from the interior side of the window frame 12.

Various methods of removing the glass panel 11 from the installed window assembly 10, with finish surround 78, 79 installed around the entire interior and exterior of the installed window assembly, will now be described. The glass panel 11 may need to be removed from the installed window frame 12 for various reasons, such as a crack, scratch, or other damage to the glass panel 11.

In one embodiment, the method includes removing the respective interior retainers 76*c*, 76*d* from the respective interior retainer attachments 74*c*, 74*d* of the right side member 14*c* and left side member 14*d*. Then, the glass panel 11 is moved upward into the edge space 104*a* in the head member 14*a*. In this position, the glass panel 11 is pivoted to move the bottom edge of the glass panel 11 interiorly out from the sill member 14*b*. The glass panel 11 is then moved downward to remove the top edge of the glass panel 11 out from the head member 14*a*. This removes the entire glass panel 11 to the interior of the installed window frame 12. In most cases, at least prior to pivoting the glass panel 11, at least some of the interior finish surround 78*c*, 78*d* is removed from around the interior of the right side member 14*c* and left side member 14*d*, to allow the glass panel 11 to be pivoted interiorly. Also, if the window assembly 10 includes a fin member 58, the fin member 58 is removed by removing the fasteners attaching the fin member 58 to the shelf portions 52*a*, 52*b*, and removing the structural adhesive 94.

In an alternative method, the glass panel 11 may be removed to the exterior of the window frame 12 by removing the respective exterior retainers 68*c*, 68*d* from the respective interior retainer attachments 62*c*, 62*d* of the right side member 14*c* and left side member 14*d*. Then, the glass panel 11 is removed similarly to method described above, except that the bottom edge of the glass panel 11 is pivoted exteriorly, and the glass panel 11 is removed to the exterior of the window frame 12. Similar to the method above, at least prior to pivoting the glass panel 11, at least some of the exterior finish surround 79*c*, 79*d* is removed from around the exterior of the right side member 14*c* and left side member 14*d*, to allow the exterior retainers 68*c*, 68*d* to be removed and to allow the glass panel 11 to be pivoted exteriorly.

Another method is directed to removing a glass panel 11 comprising multiple glass panes 84*a*, 84*b* attached edge to edge using structural adhesive from an installed window assembly 10 with finish surround 78, 79 installed around an entire interior and exterior of the installed window assembly 10. The method includes detaching the first glass pane 84*a* from the and second glass pane 84*b* removing the structural adhesive 94. The first glass pane 84*a* is removed from the window assembly 10 by first moving the first glass pane 84*a* sideways out of the right side member 14*c* (i.e., sliding it to the left, as viewed from the exterior, which moves the right edge of the first glass pane 84*a* out of the right side member 14*c*. The first glass pane 84*a* is moved upward into the edge space 104*a* in the head member 14*a* and then is pivoted to move the bottom edge of the first glass pane 84*a* interiorly out from the sill member 14*b*. The first glass pane 84*a* is moved downward to remove the top edge of the first glass pane 84*a* out from the head member 14*a*. The second glass pane 84*b* is removed from the window assembly 10 similarly, except that it is moved sideways out of the left side member 14*d* (i.e., sliding it to the right, as viewed from the exterior). In a very innovative aspect of this method of removing the multi-paned glass panel 11, the entire glass panel 11 is removed without removing any of the finish surround 78, 79, including not removing any of the finish surround 78*c*, 78*d* from around the interior of the right side member 14*c* and left side member 14*d*.

If the glass panel 11 comprises one or more additional interior panes 84 attached edge to edge between the first glass pane 84*a* and second glass pane 84*b*, they may be removed by simply moving the interior glass pane 84 upward into the edge space 104*a* in the head member 14*a* and pivoting the interior glass pane 84 to move the bottom edge of the interior glass pane 84 interiorly out from the sill member 14*b*. Then, the interior glass pane 84 is moved downward to remove the top edge of the interior glass pane 84 out from the head member 14*a*.

In alternative methods of removing the glass panel 11 from the window assembly 10, any one or more of the exterior retainers 68*a*, 68*b*, 68*c*, 68*d* and/or interior retainers 76*c*, 76*d* may be removed prior to removing the glass panel 11 or glass panes 84 of the glass panel 11. Removing one or more retainers 68, 76 may facilitate moving the glass panel 11 or glass panes 84 within the frame members 14, and also pivoting and removing the glass panel 11 or glass panes 84.

Although particular embodiments have been shown and described, it is to be understood that the above description is not intended to limit the scope of these embodiments. While embodiments and variations of the many aspects of the invention have been disclosed and described herein, such disclosure is provided for purposes of explanation and illustration only. Thus, various changes and modifications may be made without departing from the scope of the claims. For example, not all of the components described in the embodiments are necessary, and the invention may include any suitable combinations of the described components, and the general shapes and relative sizes of the components of the invention may be modified. The invention, therefore, should not be limited, except to the following claims, and their equivalents.

What is claimed is:

1. A method of installing a window assembly into a window framing of a wall of a building, the window assembly comprising:

a window frame which mounts in a window framing, the window frame having a plurality of frame members including a head member, a sill member, and a left side member, which form a perimeter of the frame, each of the frame members having a respective full length from a first end to a second end thereof;

each of the frame members having an interior portion and an exterior portion, each of the interior portions and each of the exterior portions extending substantially the full length of the respective frame member, each of the interior portions configured to be positioned at an interior side of a glass panel when installed in the window frame and each of the exterior portions configured to be positioned at an exterior side of the glass panel, each of the respective interior portions connected to a respective exterior portion;

each of the interior portions of the head member and sill member having a respective gasket disposed on the respective interior portion for contacting and retaining the glass panel, each of the exterior portions of the head member, sill member, right side member and left side member having a respective exterior retainer attachment;

respective exterior retainers removably attachable to the respective exterior retainer attachments, each the exterior retainers having a gasket for contacting and retaining the glass panel, each of the interior portions of the right side member and left side member having a respective interior retainer attachment;

respective interior retainers removably attachable to the respective interior retainer attachments, each of the interior retainers having a gasket for contacting and retaining the glass panel; and wherein the window frame assembly is configured such that when the window frame is installed in the window framing and finish surround is installed around the installed window frame assembly, the window frame assembly has a frameless appearance, and the window frame is configured such that the glass panel is installed into the window frame, there is an edge space between a top edge of the glass panel and the head member allowing the glass panel to be moved planarly upward to remove the glass panel from the window assembly without removing finish surround installed around the head member and sill member, the method comprising:

installing each of the frame members of the window frame in the window framing;

positioning the glass panel into the window frame;

attaching the exterior retainers and interior retainers to corresponding exterior retainer attachments and interior retainer attachments, respectively.

2. The method of claim 1, further comprising:

installing the finish surround around an entire interior and exterior of the installed window assembly.

3. The method of claim 2, wherein the finish surround is installed around the entire interior and exterior of the installed window frame prior to positioning the glass panel into the window frame.

4. The method of claim 3, wherein the glass panel comprises a plurality of end-long spaced glass panes and each glass pane is installed into the window frame separately, and then the glass panes are attached together edge to edge using a structural adhesive.

5. The method of claim 4, further comprising:

installing a fin member having a top end and a bottom end and extending a full height of the window frame by attaching the fin member to the glass panel at the attached edge of the glass panes, and attaching the top end and bottom end of the fin member to the respective interior portions of the head member and the sill member.

6. The method of claim 1, wherein at least one of the interior retainers is attached to corresponding interior retainer attachments and one or more of the exterior retainers are unattached to corresponding exterior retainer attachments while positioning the glass panel into the window frame, and the glass panel is positioned into the window frame from the exterior.

7. The method of claim 6, wherein the finish surround is installed around an entire interior of the installed window frame prior to positioning the glass panel into the window frame.

8. The method of claim 1, wherein at least one of the exterior retainers is attached to corresponding exterior retainer attachments and one or more of the interior retainers are unattached to corresponding interior retainer attachments prior to positioning the glass panel into the window frame, and the glass panel is positioned into the window frame from the interior.

9. The method of claim 8, wherein the finish surround is installed around an entire exterior of the installed window frame prior to positioning the glass panel into the window frame.

10. A window assembly configured for installing in a window framing of a wall of a building, comprising:

a window frame which mounts in a window framing, the window frame having a plurality of frame members including a head member, a sill member, a right side member, and a left side member, which form a perimeter of the frame, each of the frame members having a respective full length from a first end to a second end thereof;

each of the frame members having an interior portion and an exterior portion, each of the interior portions and each of the exterior portions extending substantially the full length of the respective frame member, each of the interior portions configured to be positioned at an interior side of a glass panel when installed in the window frame and each of the exterior portions configured to be positioned at an exterior side of the glass panel, each of the respective interior portions connected to a respective exterior portion;

each of the interior portions of the head member and sill member having a respective gasket disposed on the respective interior portion for contacting and retaining the glass panel;

each of the exterior portions of the head member, sill member, right side member and left side member having a respective exterior retainer attachment;

respective exterior retainers removably attachable to the respective exterior retainer attachments, each of exterior retainers having a gasket for contacting and retaining the glass panel;

each of the interior portions of the right side member and left side member having a respective interior retainer attachment;

respective interior retainers removably attachable to the respective interior retainer attachments, each of the interior retainers having a gasket for contacting and retaining the glass panel; and wherein the window frame assembly is configured such that when the window frame is installed in the window framing and finish surround is installed around the installed window frame assembly, the window frame assembly has a frameless appearance, and the window frame is configured such that when the glass panel is installed into the window frame, there is an edge space between a top edge of the glass panel and the head member allowing the glass panel to be moved planarly upward to remove the glass panel from the window assembly without removing finish surround installed around the head member and sill member.

11. The window assembly of claim 10, wherein:

each of the exterior retainers and corresponding gasket extending substantially the full length of the respective frame member to which the respective exterior retainer is removably attachable; and each of the interior retainers and corresponding gaskets extending substantially the length of the respective frame member to which the respective interior retainer is removably attachable.

12. The window assembly of claim 10, wherein:

each of the interior portions includes an interior wall having an inside edge and an outside edge and a first fastening wall extending laterally from the interior wall, each of the first fastening walls having one or more bosses for receiving fasteners for mounting the respective frame member to the window framing;

each of the exterior portions includes an exterior wall having an inside edge and an outside edge and a second fastening wall extending laterally from the interior wall, each of the second fastening walls having one or more bosses for receiving fasteners for mounting the respective frame member to the window framing; and wherein each respective interior portion is connected to a respective exterior portion by connecting the respective first fastening wall of the interior portion to the respective second fastening wall of the exterior portion.

13. The window assembly of claim 12, wherein:

each of the respective interior portions is connected to a respective one of the exterior portions.

14. The window assembly of claim 12, wherein:

each of the respective interior portions is connected to a respective one of the exterior portions by connecting the respective first fastening wall of each interior portion to the respective second fastening wall of the exterior portion with a respective thermal break connector which thermally insulates the interior portion from the exterior portion.

15. The window assembly of claim 10, wherein:

the respective interior portion of the head member and sill member each further comprise a respective shelf portion, each of the shelf portions including a shelf wall extending interiorly from the interior wall of the first interior portion within the outside edge of the interior wall and a leg portion extending from an interior end of the shelf outward, each of the respective shelf walls having one or more bosses for receiving a fastener for mounting the respective frame member to the window framing.

16. The window assembly of claim 15, further comprising:

a fin member having a top end and a bottom end and extending a full height of the window frame, the fin member configured to be attached to the glass panel, the top end and bottom end of the fin member each having a plurality of bosses for receiving fasteners for mounting the fin member to the respective shelf portions of the interior portions of the head member and the sill member.

17. The window assembly of claim 16, wherein the fin member comprises a rectangular box beam and a pair of mounting feet extending from a first side of the rectangular box beam, wherein the first side and mounting feet are configured to be attached to the glass panel.

18. The window assembly of claim 17, wherein the fin member is configured to be attached to the glass panel using a structural sealant.

19. The window assembly of claim 10, further comprising:

a sill pan configured to receive the sill member and to collect water draining from the window assembly; and one or more drains coupled to a bottom of the sill pan and in fluid communication with an interior of the sill pan for draining water from the sill pan.

20. The window assembly of claim 10, further comprising:

a glass panel configured for being installed in the window frame with each of the retainers attached to the respective retainer attachment, such that each of the gaskets contacts and holds the glass panel in place in the window frame.

21. The window assembly of claim 20, wherein the glass panel comprises a plurality of laterally spaced glass panes attached together edge to edge, and the window assembly further comprises:

a fin member having a top end and a bottom end and extending a full height of the window frame, the fin member attached to the glass panel, the top end and bottom end of the fin member each having a plurality of bosses which receive fasteners that mount the fin member to the respective interior portions of the head member and the sill member.

22. The window assembly of claim 10, wherein:

the exterior retainers are selected from a selection of different exterior retainers, each different exterior retainer configured to accommodate a different thickness of glass pane in the window frame; and the exterior retainer attachments are configured to receive each of the different exterior retainers.

23. The window assembly of claim 10, wherein:

the window frame is configured such that when the glass panel is installed into the window frame, there is a respective edge space between respective edges of the glass panel and the right side member, and left side member allowing the glass panel to be moved planarly in the window frame;

the interior retainers of the right side member and left side member are configured to be removed from the respective right side member and left side member after the window assembly is installed in the wall framing and finished surround is installed around an interior of the right side member and left side member without removing the finished surround along the right side member and left side member, and a glass panel comprising a plurality of end-long spaced glass panes attached together edge to edge installed in a window frame with finish surround installed around the interior of the right side member and left side member is removable from the window frame without removing the finish surround installed around the interior of the right side member and left side member.

24. The window assembly of claim 10, wherein:

the window assembly is configured such that the glass panel when installed in the window assembly installed in the window framing with finish surround installed around the entire installed window assembly is removable from the installed window assembly without removing any of the finish surround and without breaking the glass panel.

* * * * *